US007914592B2

(12) United States Patent
Sun

(10) Patent No.: US 7,914,592 B2
(45) Date of Patent: Mar. 29, 2011

(54) METHOD FOR MANUFACTURING COTTON TOWELS

(76) Inventor: Rigui Sun, Shandong Province (CN)

( * ) Notice: Subject to any disclaimer, the term of this patent is extended or adjusted under 35 U.S.C. 154(b) by 428 days.

(21) Appl. No.: 12/181,291

(22) Filed: Jul. 28, 2008

(65) Prior Publication Data

US 2009/0235498 A1 Sep. 24, 2009

(30) Foreign Application Priority Data

Mar. 25, 2008 (CN) ..... 2008 1 0084473

(51) Int. Cl.
*D06L 3/00* (2006.01)
*D01G 9/00* (2006.01)
*D01G 1/06* (2006.01)

(52) U.S. Cl. ..... 8/918; 8/101; 19/80 R; 19/98; 19/150; 57/211; 57/236; 57/274; 57/282; 57/58.52; 57/362

(58) Field of Classification Search ..... 8/918, 101; 19/80 R, 98, 150; 57/211, 236, 274, 282, 57/58.52, 362
See application file for complete search history.

(56) References Cited

U.S. PATENT DOCUMENTS

2004/0131821 A1* 7/2004 Mandawewala ..... 428/97
* cited by examiner

*Primary Examiner* — Lorna M Douyon
*Assistant Examiner* — Amina Khan

(57) ABSTRACT

The present invention relates to the production of textiles and more particularly pertains to a method for manufacturing cotton towels comprising the steps of: combining a yarn of 120S combed long staple cotton and a yarn of 10S combed long staple cotton by means of a double winder and winding onto a bobbin or bobbins after combining; feeding the bobbin or bobbins of the combined yarn into a double twister for plying; winding the plied yarn onto a bobbin and weaving into greige; impregnating the greige in the solution of a combined desizing, scouring and bleaching machine to be soaked and steamed for removing the sizes and the impurities in the cotton yarn; treating the greige by means of deoxidization, dyeing, enzymatic desizing, softening, relaxation drying and sewing into towels. The present invention adopts the 120S combed long staple cotton for plying which achieves a definitive binding effect on the loosened fibers on the surfaces of the yarn, thereby forming fewer fluffs on the surfaces of the towel. The present invention eliminates the step of removing the water-soluble filaments, reduces the labor intensiveness of the workers, relieves the pressure on the sewage treatment and alleviates the problems of the environmental pollution.

5 Claims, No Drawings

METHOD FOR MANUFACTURING COTTON TOWELS

BACKGROUND OF THE INVENTION

The present invention relates to the production of textiles and more particularly pertains to a method for manufacturing cotton towels.

The production of cotton towels in the prior art comprises the steps of turning bales of raw cotton into yarns of 10S long staple cotton with 3 twists per 10 cm by means of opening and picking, carding, drawing, roving, spinning and winding onto bobbins in succession, winding side by side the cotton yarns and water-soluble filaments upon a bobbin, combining the 120S/1 water-soluble filaments and the yarns of 10S/1 long staple cotton for double twisting, and after double twisting the twist is 39 twists per 10 cm, winding onto a bobbin, section warping, weaving into semi-finished greige, treating the greige by means of a combined desizing, scouring and bleaching machine to remove the water-soluble filaments in five courses (namely, under the conditions that the pressure is about 0.3 Mpa and the speed is at 12-15 meters per minute, rinsing in water at a high temperature of 100° C. in two courses and at the room temperature in three courses to remove the water-soluble filaments), adding a desizing agent and a wetting agent into an overflowing machine for desizing, then scouring and bleaching in a solution of sodium hydroxide, flow pretreatment agent and hydrogen peroxide, and adding citric acid for neutralization, using a deoxy enzyme for deoxidization, using 150% 3RS yellow dye, anhydrous sodium sulfate and sodium carbonate for dyeing, soaping with abstergent LS, softening with a softener, drying, and sewing into towels; wherein the RS yellow dye is a reactive dye manufactured by DYSTAR of Germany being a major ingredient in the dyeing process of the fabrics; and LS is an abstergent manufactured by CLARIANT of Switzerland having the function of removing the disengaging colors on the surfaces of the fabrics after dyeing.

However, in the prior art water-soluble filaments and yarns of 10S combed long staple cotton are plied. After the water-soluble filaments are decomposed, the twist of the remaining long staple cotton is too small (about 4-6 twists per 10 cm), thereby causing the fibers on the surfaces of the yarns to be untwined with loose ends extending in all directions, forming large areas of fluffs on the surfaces of the towel. After the towel is rinsed for the second time, the fluffs are removed from the towel by the current of the water as pompons. The more the fluffs, the more the pompons.

BRIEF SUMMARY OF THE INVENTION

The present invention provides a method for manufacturing cotton towels which produces finished cotton towels with fewer fluffs on the surfaces thereof and shortens the manufacturing process.

To attain this object, the present invention adopts the following technical proposal:

A method for manufacturing cotton towels comprises the steps of: combining a yarn of 120S combed long staple cotton and a yarn of 10S combed long staple cotton by means of a double winder and winding onto a bobbin or bobbins after combining; feeding the bobbin of the combined yarn into a double twister for plying; winding the plied yarn onto a bobbin and weaving into greige; impregnating the greige in the solution of a combined desizing, scouring and bleaching machine to be soaked and steamed for removing the sizes and the impurities in the cotton yarn; treating the greige by means of deoxidization, dyeing, enzymatic rinsing, softening, relaxation drying and sewing into towels.

The advantages and effects of the present invention are:

The method for manufacturing cotton towels of the present invention adopts a yarn of 120S combed long staple cotton (with the twist at 180 twists per 10 cm) as a substitute for the water-soluble filaments in plying with a yarn of 10S combed long staple cotton (with the twist at 33 twists per 10 cm), with the twist of the plied yarn at 24 twists per 10 cm, and after the process the twist of the remaining 10S combed long staple cotton is 8-9 twists per 10 cm, the 120S combed long staple cotton in the plied yarn is still twisted with the 10S long staple cotton achieving a definitive binding effect on the loosened fibers on the surfaces of the yarn, thereby forming fewer fluffs on the surfaces of the cotton towel. The manufacturing process of the present invention eliminates the step of removing the water-soluble filaments, reduces the labor intensiveness of the workers, relieves the pressure on the sewage treatment and alleviates the problems of the environmental pollution.

DETAILED DESCRIPTION OF THE INVENTION

The preferred embodiment of the present invention is further described in detail. It comprises the following steps:

Raw cotton treatment process: Cotton flocks are pulled out from a plurality of cotton bales by means of a bale plucker (as cotton is compressed into bales for ease of transportation to spinning mills, and raw cotton contains lots of impurities and dirt) and are fed into a cotton opener after being initially fluffed up and blended.

Cotton opening and picking process: After the raw cotton is blended, the cotton is fluffed up and the impurities are filtered out from the cotton by means of a cotton opener. The fluffing up of the cotton by the cotton opener is to employ a high-speed rotating beater (disposed with blades, spikes or teeth) to beat, separate and card the raw cotton, thereby attaining the effect of reducing the fiber-to fiber cohesion or the cohesion between fibers and impurities. A grate-shaped dust grid formed by a plurality of triangular dust bars is disposed on the periphery of the beater to remove impurities. After the processing by the high-speed rotating beater, the fibers and the impurities are thrown onto the dust grid and collide with the dust bars, the fibers are retained by the dust bars and the impurities fall from the gaps between the dust bars. After going through the said series of mechanical processes, the raw cotton has been fluffed up and blended to a certain extent. Some larger impurities have already been removed but a certain quantity of broken seeds remain in the cotton, seed fragments and short fibers are required to be further fluffed up and removed by means of a cotton picker. The functions of the cotton picker are to continue to fluff up and evenly blend the raw cotton, to continue to remove from the cotton leaf fragments, broken seeds, other impurities and some short fibers, to control and increase the evenness both lengthwise and crosswise throughout the cotton layer, and to produce cotton laps or cotton layers of required specification. The fibers in a cotton lap are mostly in a state of loose cotton bats in cotton clusters and contain 40%-50% of impurities.

Carding process: The processed cotton laps or cotton layers are fed into a carding machine for fine and complete combing, fiber clusters are separated into single fibers and the fibers are straightened. The residual impurities and dirt in the cotton layers are further removed. The fibers are sufficiently blended by the carding machine and even elliptical card slivers of required density are formed and which are disposed in a sliver can in regular coils for processing by the next step.

Drawing process: The card slivers produced from the carding machine are initially paralleled and straightened to form rovings in their initial state. However, due to the high unevenness rate of the card slivers, the disordered line-ups of the fibers thereof and the hooked state of most of the fibers, the card slivers are therefore required to be drawn prior to spinning so as to improve the evenness and the state of the fibers of the card slivers. The drawing process mainly comprises:

(1) Combining: 6-8 card slivers are combined and fed into a drawing frame to produce a cotton sliver. As this provides chances of coinciding of the thick segments with the thin segments of each of the slivers, the unevenness rate of the segments of the slivers can be improved. The unevenness rate by weight of the card slivers is about 4.0% and the unevenness rate by weight of the combined slivers is reduced to 1% or below.

(2) Drafting: The slivers are drawn out to become as thin as its original state by drafting, and the state of the fibers is simultaneously improved. The hooked and curled fibers are further straightened and paralleled and the small cotton clusters are further separated into single fibers. By means of varying the multiples of the drafting, the consistent weight of the sliver can be effectively controlled.

(3) Blending: By the method of repeated combining the slivers, single fibers are further blended, thereby ensuring the evenness of the blended cotton composition of the slivers and stabilizing the quality of the finished yarn.

(4) Sliver finishing: The slivers produced from the drawing frame are disposed in a sliver can in regular coils for ease of transportation and storage and for processing by the next step.

Roving process: The slivers are fed into a roving machine for drawing to be thinner by 5-12 times, thereby making the fibers to be further straightened and paralleled. As after being drafting by the roving machine the number of fibers on the cross-section of a sliver is only a few, the degrees of straightening and paralleling are high and so the strength is lower. Therefore, a certain degree of twisting is required to increase the strength of the rovings so as to avoid accidental stretching during winding and unwinding, and to prepare the rovings for drafting and spinning into yarn. The rovings after being twisted are wound onto bobbins to form spools of rovings of required shape and size for ease of storage and transportation and adopted for feeding in for spinning.

Spinning process: The rovings are fed into a spinning machine for drawing out and spinning into a yarn of required linear density. (The preceding processes for the two types of yarns, J10S or J100S, are the same. The only difference is that the degrees of drafting and thinning in the spinning process are different. The J10S yarns are 10 times thicker than the J100S yarns.) After being drafted, an appropriate degree of twisting is added to the roving. As the medium long staple cotton is used and it has been combed, despite the twist is fewer in the finished yarn, it can still be spun normally. The J120S yarn is produced by the manufacturing method of normal high yarn count with the twist of about 180 twists per cm, and the spun yarn is wound onto bobbins according to required specification.

Winding process: The bobbins of J120S yarn and J10S yarn produced from the spinning process are combined by a winding machine and wound onto a bobbin. In the winding process, due to the greater difference in the yarn count of the two yarns, their elastic stretching length is of greater difference. The two kinds of yarns are therefore tensioned by different tension plates when they are combined, with the J120S yarn tensioned by about 6 g and the J10S yarn tensioned by about 35 g, and the speed of winding is reduced appropriately, thereby ensuring the two yarns of greater difference in thickness can be combined evenly and in parallel and thereby further ensuring the twist is evenly distributed when they are plied.

Double twisting process: The bobbin of the combined yarn is fed into a double twister for plying. In this double twisting process, due to the two strands of yarns are of Z-twist, the plied yarn is processed with a S-twist. The object of adding the S-twist is to twist the two strands of single yarns together on one hand. On the other hand, the twists of the two strands of single yarns are reduced. The plied twist is 24 twists per 10 cm, and so 24 twists of the J10S yarn are untwisted leaving the remaining twist of 8 twists per 10 cm. As the twist of the J120S single yarn is greater per se, the change is not big after the untwisting.

Yarn winding process: The yarn after the double twisting is wound onto a bobbin of yarn. The finished yarn of the J120S yarn and the J10S yarn is successfully spun and which is even, glossy, gentle, fluffy and soft.

Desizing, scouring and bleaching process: The 150 kg greige is placed into 1,500 L of water, impregnated and soaked in the solution of the combined desizing, scouring and bleaching machine (the said solution contains sodium hydroxide, flow pretreatment agents and hydrogen peroxide, the concentration of which are 5 mL/L, 3 mL/L and 7.8 mL/L respectively). The greige is then steamed at the temperature of 100° C. for 60 minutes in the solution of the combined desizing, scouring and bleaching machine so as to attain the objects of desizing, removing impurities in the cotton yarn and increasing the whiteness of the greige. The flow pretreatment agent therein is an auxiliary manufactured by CLARIANT of Switzerland having the function of combining three properties in one, namely, refining, stabilizing and lubricating, thereby ensuring the smoothness of the fabric during the processes of bleaching and dyeing.

Deoxidizing process: The griege is gently rinsed at the temperature of 100° C. for 10 minutes in the citric acid solution of concentration of 1 mL/L of the overflowing machine, thereby neutralizing the PH value of the solution. The griege is then rinsed at the temperature of 40° C. for 20 minutes in the deoxy enzyme N255 solution of concentration of 0.12 mL/L to attain the object of deoxidization.

Dyeing process: 0.0157 g/L of 150% 3RS yellow dye, small amount of anhydrous sodium sulfate and 0.05 g/L of sodium carbonate and other dyeing chemicals are added into the overflowing machine, and the greige is gently rinsed at the temperature of 60° C. for 30 minutes for coloring.

Soaping process: The greige is rinsed at the temperature of 90° C. for 10 minutes in an abstergent LS solution of concentration of 0.13 g/L to remove the residual dyeing chemicals.

Enzymatic rinsing process: 0.5 L of citric acid is first added to make the solution mildly acidic, and 1.5 L of cellulases is then added, and the greige is gently rinsed at the temperature of 50° C. for 20 minutes to reduce the fluffs on the warping yarn.

Softening process: 3 L of JWJ softener of concentration of 2 mL/L is added, and the greige is rinsed at the temperature of 40° C. for 20 minutes to make the fabric softer. The fabric then goes through the relaxation drying process and the sewing process and is manufactured into towels. JWJ therein is a softener manufactured by CLARIANT of Switzerland having the function of making the fabric softer during the treatment process.

The above embodiment is a preferred embodiment of the present invention providing detailed descriptions of the method for manufacturing cotton towels. Variations and changes on the embodiment and the scope of application may be made by those skilled in the art without departing from the spirit of the present invention. To sum up, the details of the embodiment of the present invention should not be understood as limitations thereof.

What is claimed is:

1. A method for manufacturing cotton towels comprising the steps of:

combining a yarn of 120S combed long staple cotton and a yarn of 10S combed long staple cotton by means of a double winder and winding onto a bobbin or bobbins after combining;

feeding the bobbin or bobbins of the combined yarn into a double twister for plying;

winding the plied yarn onto a bobbin and weaving into greige;

impregnating the greige in the solution of a combined desizing, scouring and bleaching machine to be soaked and steamed for removing the sizes and the impurities in the cotton yarn; and treating the greige by means of deoxidization, dyeing, enzymatic rinsing, softening, relaxation drying and sewing into towels.

2. The method for manufacturing cotton towels as in claim 1, further comprising the steps of:

opening and picking, in which after the raw cotton is blended, the cotton is fluffed up and the impurities are filtered out from the cotton by means of a cotton opener and the cotton is further fluffed up and its impurities are further filtered out by means of a cotton picker and the raw cotton is processed into cotton laps or cotton layers of required specification;

carding, in which the processed cotton laps or cotton layers are fed into a carding machine for fine and complete combing, fiber clusters are separated into single fibers and the fibers are straightened to form even elliptical card slivers of required density which are disposed in a sliver can in regular coils, and the card slivers produced from the carding machine are initially paralleled and straightened to form rovings in their initial state;

roving, in which the card slivers are fed into a roving machine for drawing to be thinner by 5-12 times, thereby making the fibers to be further straightened and paralleled to form rovings, and the rovings are twisted and then wound onto bobbins or a bobbin to form spools of rovings of required shape and size; and spinning, in which the rovings are fed into a spinning machine for drawing out and spinning into a yarn of required linear density, and the spun yarn is wound onto bobbins or a bobbin according to required specification.

3. The method for manufacturing cotton towels as in claim 1, wherein the solution comprises sodium hydroxide, flow pretreatment agent and hydrogen peroxide.

4. The method for manufacturing cotton towels as in claim 1, wherein the concentrations of the sodium hydroxide, the flow pretreatment agent and the hydrogen peroxide are 5 mL/L, 3 mL/L and 7.8 mL/L respectively.

5. The method for manufacturing cotton towels as in claim 1, wherein the greige in the solution of the combined desizing, scouring and bleaching machine is steamed at the temperature of 100° C. for 60 minutes.

* * * * *